US006499673B1

(12) United States Patent
Braun, Jr. et al.

(10) Patent No.: US 6,499,673 B1
(45) Date of Patent: Dec. 31, 2002

(54) PATTERN CONTROLLABLE DISPENSING APPARATUS

(75) Inventors: Arnold W. Braun, Jr., Trenton, MI (US); David J. Cliff, Northville, MI (US); David G. Gonska, Beverly Hills, MI (US); Masoud Amin-Javaheri, West Bloomfield, MI (US); David C. Mandeville, Plymouth, MI (US); Mark E. Ulrich, Brooklyn Park, MN (US); Stanley G. Karwoski, Oakdale, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 09/578,842

(22) Filed: May 25, 2000

Related U.S. Application Data

(63) Continuation-in-part of application No. 08/982,863, filed on Dec. 2, 1997.
(60) Provisional application No. 60/032,067, filed on Dec. 2, 1996.

(51) Int. Cl.[7] ..... B05B 3/00
(52) U.S. Cl. ..... 239/263.1; 239/225.1; 239/229; 239/236; 239/264; 239/380

(58) Field of Search ..... 239/225.1, 229, 239/236, 263.1, 264, 380

(56) References Cited

U.S. PATENT DOCUMENTS

| | | | | |
|---|---|---|---|---|
| 3,874,595 | A | * | 4/1975 | Rindisbacher |
| 4,369,850 | A | * | 1/1983 | Barker |
| 4,659,018 | A | * | 4/1987 | Shulman |
| 4,744,517 | A | * | 5/1988 | Iwamoto et al. |
| 5,279,373 | A | * | 1/1994 | Smet |
| 5,794,854 | A | * | 8/1998 | Yie |

FOREIGN PATENT DOCUMENTS

| | | | |
|---|---|---|---|
| EP | 0203830 | 5/1986 | ..... B05B/13/04 |

* cited by examiner

*Primary Examiner*—Robin O. Evans
(74) *Attorney, Agent, or Firm*—Douglas B. Farrow

(57) ABSTRACT

The apparatus is designed to dispense sealants and adhesives onto a workpiece in a robotic or manual application. The apparatus has a motor, a through shaft and a rotating shaft. The rotating shaft is hollow and has an off-center aperture at the end thereof through which extends one end of the through shaft. By rotating the rotating shaft, the end of the through shaft has imparted to it an orbital motion which is capable of providing a swirl type pattern onto the workpiece.

5 Claims, 5 Drawing Sheets

PATTERN CONTROLLABLE DISPENSING APPARATUS

RELATED APPLICATIONS

This application is a continuation-in-part of U.S. application Ser. No. 08/982,863, filed Dec. 2, 1997, which is in turn a continuation-in-part of U.S. application Ser. No. 60/032,067, filed Dec. 2, 1996, now abandoned.

BACKGROUND OF THE INVENTION

Devices have been used to apply adhesive to work pieces such as automotive bodywork for a number of years. Such devices have ranged from simple nozzles which dispense a bead of material in a line according to the motion of the robot to swirl type applicators such as those shown on U.S. Pat. Nos. 3,911,173; 4,031,854; and 4,098,632. Efforts have also been made to provide a swirl pattern in U.S. Pat. Nos. 4,659,018 and 5,322,564.

While such devices are effective in some applications, often they lack the versatility necessary to perform a wide variety of operations using the same applicator.

SUMMARY OF THE INVENTION

It is therefore an object of this invention to provide a single application device which is capable of dispensing material having a wide range of viscosities in both wirling and streaming patterns and which provides accurate control over the bead characteristics of the material applied.

It is further an object of this invention to provide a dispenser which is capable of being used with all manual and automatic sealant and adhesive dispense valves and associated equipment and which can be used for applications such as PVC, hem flange, liquid mask, body shop and trim shop applications.

This dispensing apparatus consists of eight main components. The first component is a bellows, dust cap or other cover which is used to protect the end of the device and prevent adhesive materials and other potentially damaging particles from entering the device. Secondly, bearings are provided to allow the parts to rotate relative to one another. In the preferred embodiment ball or spherical bearings are used, however it is understood that other types of bearings such as polymeric bearings may be utilized to allow relative rotation of parts.

A motor is used to provide rotational energy and in the preferred embodiment the rotational speeds may be up to 32,000 RPM. Optionally, on the back of the motor is a rotary encoder which is used to determine the angular position of the motor shaft. The motor shaft is in turn attached to a rotating shaft which has on the end thereof a off-center aperture such the diameter of the orbit imparted is approximately 1/16" in the preferred embodiment. Of course larger or smaller orbits may be used as desired and such modifications are easily within the ambit of one skilled in the art.

Extending through the center of the rotating shaft and separated by an annular space therefrom is a through shaft which in the preferred embodiment is formed of a solid stainless steel tube that flexes and which is capable of retaining pressures of upwards of 3500 psi (including a substantial safety factor). This stainless steel tube allows the through shaft to flex and transport the material to be dispensed to the tip which may be anything from a simple single aperture to shaped or multiple apertures located at the end of the through shaft. Alternatively, a hose having a braided steel covering may be used for a through shaft.

Thus, one apparatus (and tip) can be used to provide multiple separate, unique and desirable application patterns (stream and swirl) and further allows reduced maintenance compared to existing systems. It is believed that the instant invention also allows faster material application and robotic applications and allows exact control over the dispensing pattern. It is also further allows independent control of the flow and bead pattern, such independent control being more difficult in the known prior art.

The bead pattern of the material can be accurately controlled by varying the following factors: standoff distance of apparatus from substrate, material pressure, motor speed, rotating shaft hole offset, nozzle tip and feed rate (rate at which the applicator moves with respect to the substrate). By changing these factors, the bead width can be varied from less than one inch to several inches. The bead height can also be varied over any range desirable and additionally the bead pattern can be open or closed (whether the substrate is entirely covered or not covered along the length where material has been deposited).

It is further understood that located inside the through shaft may be a static mixer which is in turn connected to an inlet for multiple component materials. Such an apparatus allows application of multicomponent materials while at the same time having the extreme flexibility with respect to applications set forth above for the basic single component material apparatus.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
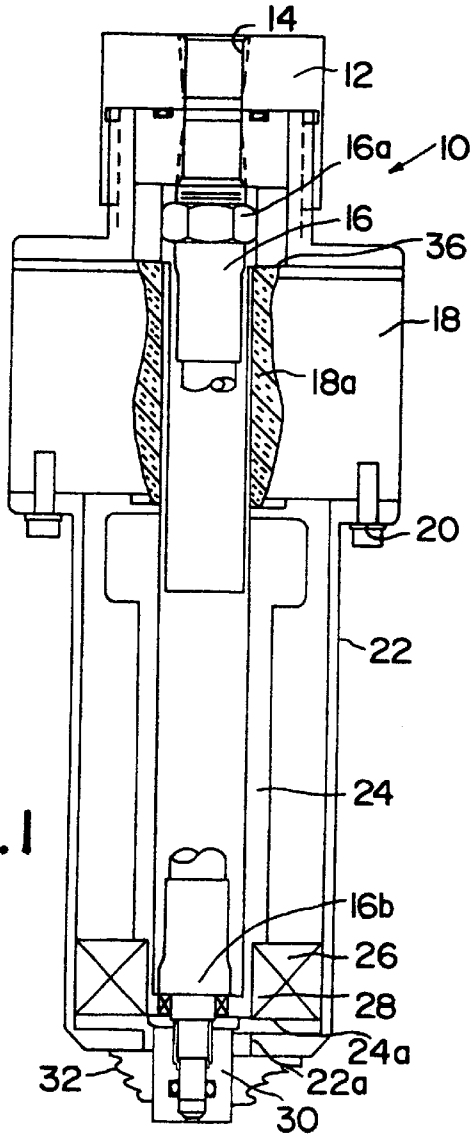
FIG. 1 is a partially cutaway cross-sectional view showing the apparatus of the instant invention.

The instant invention is shown generally in FIG. 1 and is designated 10. Dispenser 10 is comprised of an upper housing 12 having a threaded inlet 14 which has threadedly attached at its other end thereof through shaft 16 which has an NPT fitting 16*a* at the upper end thereof threaded into upper housing 12.

Attached to the bottom of upper housing 12 is motor 18 which in the preferred embodiment is a brushless DC motor which is designed to operate at speeds of up to about 32,000 RPM. Motor 18 has a central aperture 18*a* through which through shaft 16 extends. Attached to the bottom of motor 18 via fasteners 20 is lower housing 22.

Rotatably mounted inside of lower housing 22 is rotating shaft 24 which is attached to the bottom end of the rotating portion of motor 18 and which rotates therewith. Rotating shaft 24 is mounted in lower housing 22 via bearings 26 which may be ball bearings, spherical bearings or other known types of bearings. Rotating shaft 24 has an offset opening 24*a* on the bottom end thereof. The offset is such that the total diameter of the orbit in the preferred embodiment is 1/16". Located in opening 24*a* is lower bearing 28 which serves to allow rotation between through shaft 16 and rotating shaft 24. Bearing 28 again may be a ball bearing, spherical bearing or other known type.

The lower end 16*b* of through shaft 16 has threaded into it a tip 30 which extends through an aperture 22*a* in the lower end of lower housing 22. The tip 30 may be a simple round orifice or otherwise A bellows 32 may be provided to seal the opening between opening 30 and lower housing 22 and prevent the migration of adhesive material into dispenser 10.

A rotary encoder 36 may be mounted on the upper or back end of the motor 18 and allows precise knowledge (and control) of the rotational position of the dispense nozzle 30 for streaming applications. The motor may also have an internal position sensor which may be utilized similarly.

Figure 2:
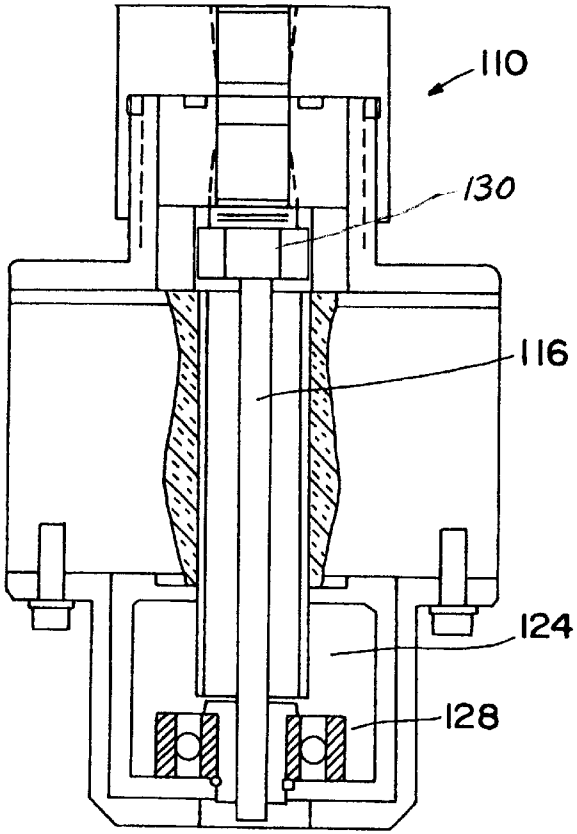
FIG. 2 is a similar view of an alternate embodiment of the instant invention.
Figure 5:
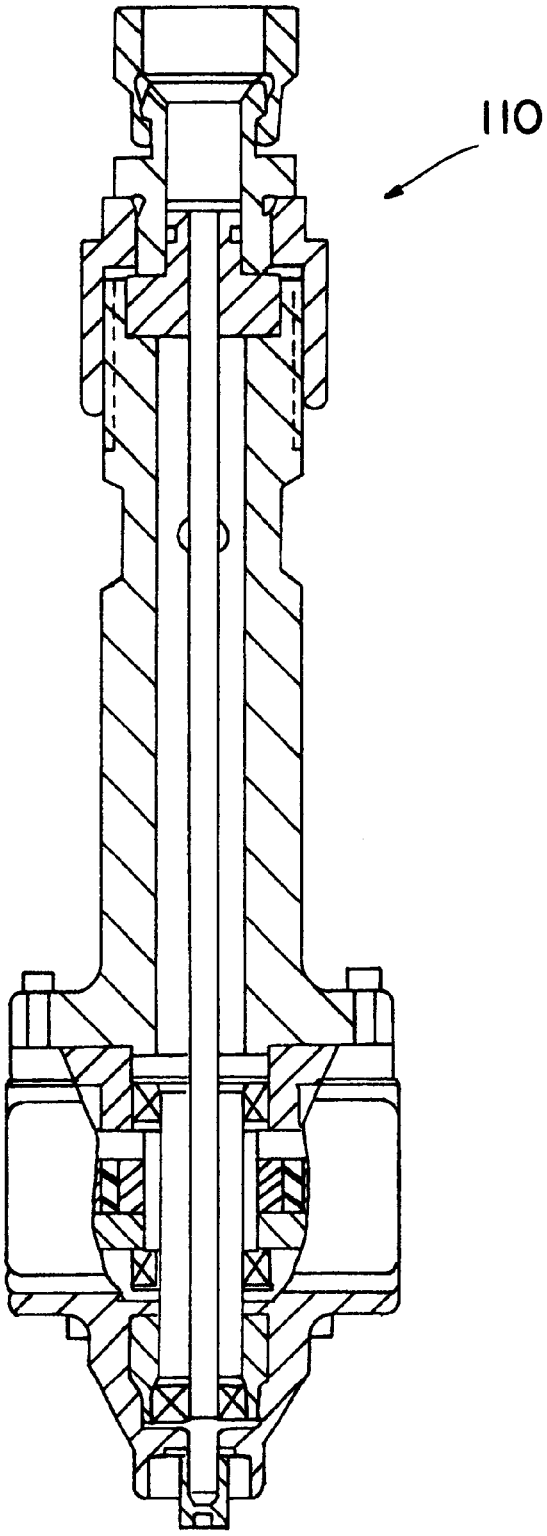
FIG. 5 is a partially cutaway cross-sectional view showing the apparatus of the instant invention.

FIGS. 2 and 5 show an alternate embodiment of the dispenser designated 110 and is similar in nature to the FIG. 1 design except rather than having a braided hose for through shaft member 16 the FIG. 2 embodiment utilizes a simple tube made of stainless steel for through shaft 116 which is journaled via bearing 128 relative to rotating shaft 124. Shaft 116 is affixed to fitting 130 by used of an adhesive (or by brazing or other methods).

Figure 3:
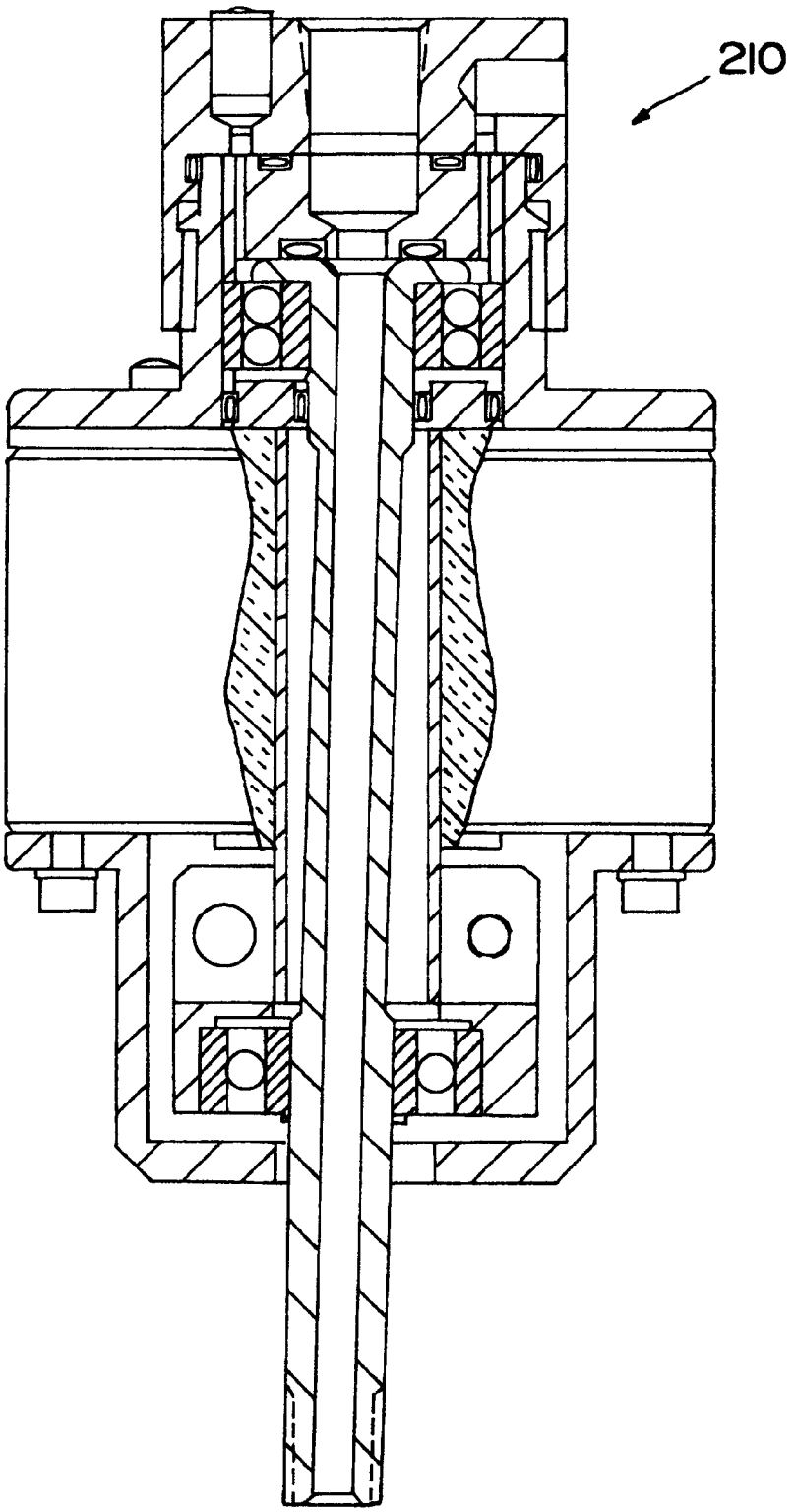
FIG. 3 is yet another alternate embodiment of the instant invention.

FIG. 3 shows yet another alternate embodiment 210 which is similar in nature to the other embodiments described above.

Figure 4:
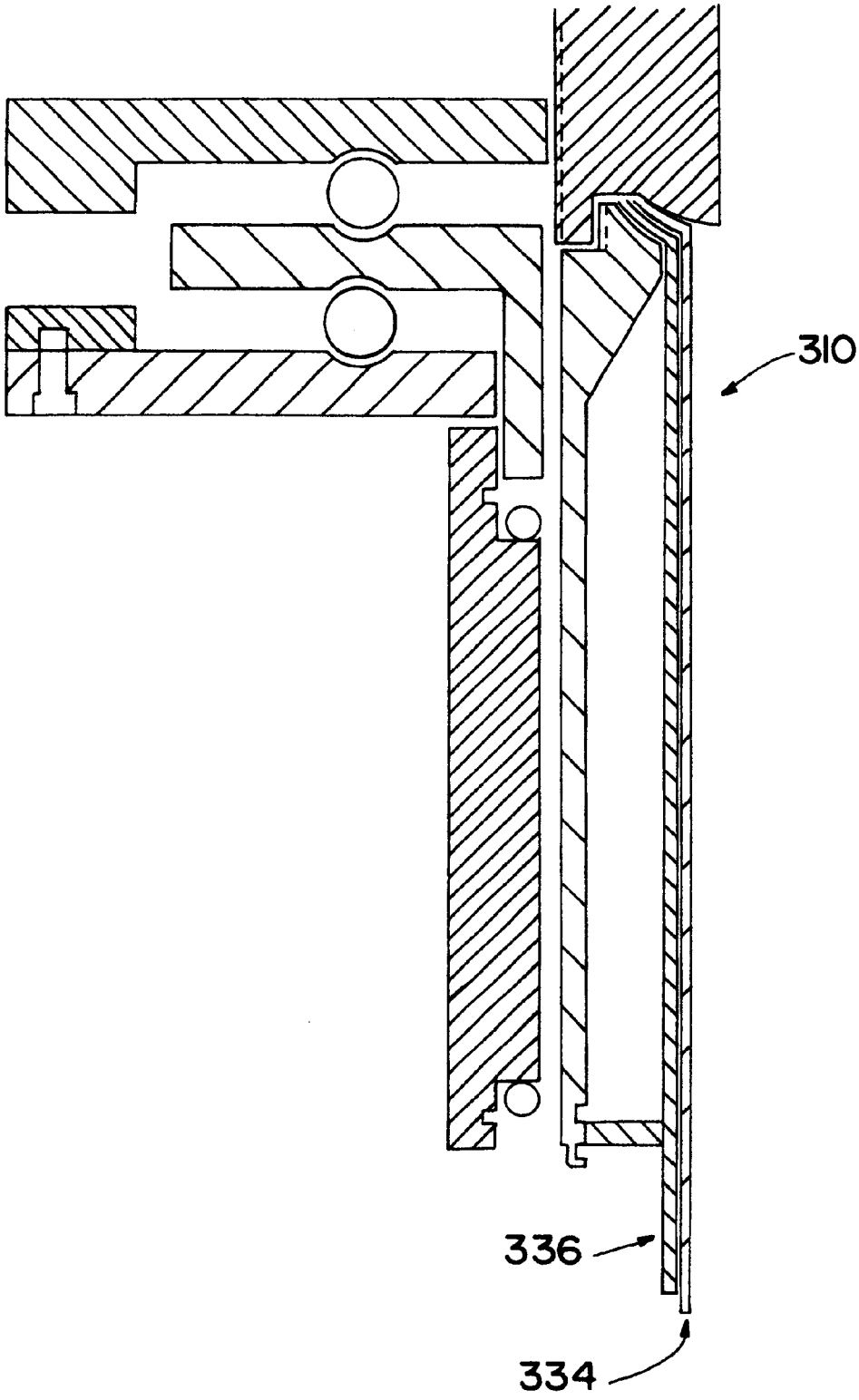
FIG. 4 shows an alternate embodiment of the instant invention suitable for application of plural component materials.

FIG. 4 shows an alternative embodiment 310 which provides the ability to dispense plural component materials from a similar system. A sleeve 336 is provided about mixer 334 which provides the strength and support to allow the mixer to operate at high pressures. The mixer sleeve 336 fits tightly above the static mixer 334 and supports the static mixer 334 along its entire length thereby allowing high pressure operation. The top outside of the mixer sleeve 336 is semi-spherical as shown in the diagram. At the top of the mixer sleeve 336 on the inside, the shape conforms to the static mixer 334. The static mixer 334 and mixer sleeve 336 are supported by the threaded tube and the top of the threaded tube has a spherical shape on the inside and a threaded section on the outside. When the threaded tube is threaded onto a mating nozzle, the static mixer and mixer sleeve are pressed against the nozzle creating a pressure tight seal. Because of the spherical shape of the static mixer tube, they are free to swivel while in the threaded tube and still maintain a tight seal against the nozzle.

The static mixer, mixer sleeve and threaded tube fit inside the rotating tube which has an off-set hole at the application end. The rotating tube is supported by the motor and as the tube rotates the static mixer, mixer sleeve and threaded tube are forced by the off-center hole of the rotating tube to orbit. By unthreading the threaded tube, the static mixer can be removed. The static mixer is a disposable item that can be replaced when the material cures in the tube between production shifts or overnight.

Figure 6:
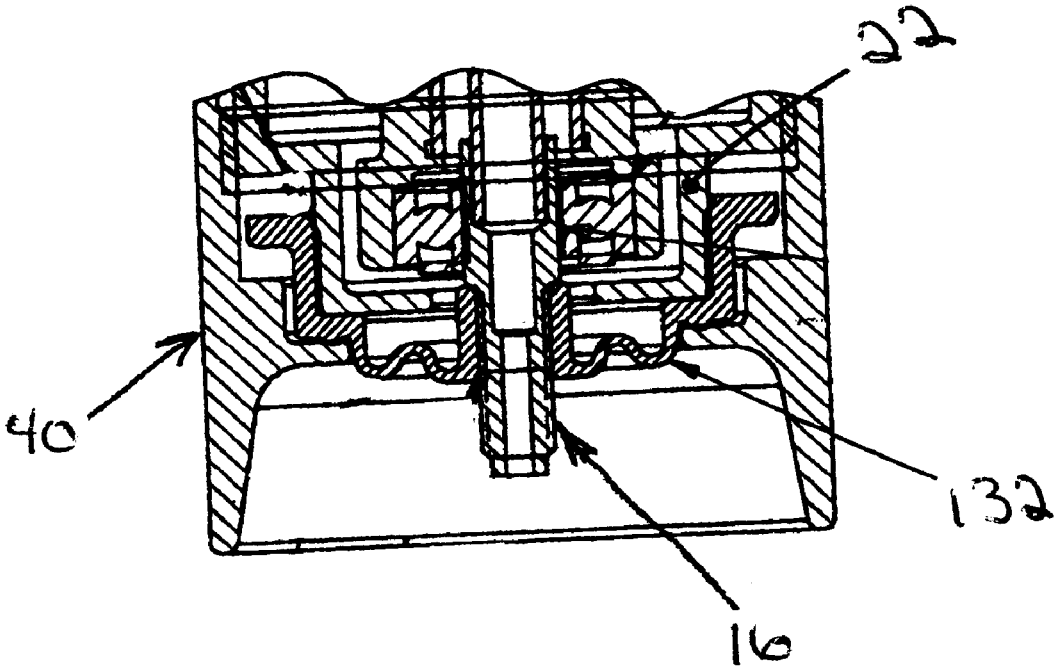
FIG. 6 is a detailed cross-sectional view showing the coupler bearing guard of the apparatus of the preferred embodiment of the instant invention.

FIG. 6 shows a coupler guard bellows 132 which is formed of 60 durometer Buna-N rubber and pressed onto the fluid tube 16 and yet which allows the tube 16 to orbit freely at up to 24,000 rpm. This allows much enhanced bearing life preventing contaminants from entering the bearing 16 and retains grease from bearing 16 inside the housing so that it does not contaminate the surface to which material is being applied. The outer diameter of the guard is pressed onto the housing 22. An aluminum cup 40 is threaded onto the end of housing 22 and protects fluid tube 16 from collisions and retains errant dispensed material in a smaller area for enhanced cleanup time. Guard 132 may be easily cleaned or replaced when desired.

It is contemplated that various changes and modifications may be made to the dispenser without departing from the spirit and scope of the invention as defined by the following claims.

What is claimed is:

1. A robotically mountable orbital dispenser for application of viscous materials and connected to a source thereof, said dispenser comprising:

a housing having first and second ends;

a tube having first and second ends, said tube first end having an axis and being firmly fixed to said housing adjacent said housing first end and wherein said tube is constructed of such a length, thickness and material as to allow it to flex while swirling;

means for imparting a rotary motion being located in said housing, said means comprising a motor having an axis of rotation, a rotating shaft having first and second ends and being mounted inside said housing and having an axis of rotation, said tube first end axis, said motor axis of rotation and said shaft axis of rotation being generally coincident, said shaft first end being attached to said motor and said shaft second end being rotatably mounted in said housing second end said tube second end being eccentrically and rotatable mounted in said shaft second end so as to allow a swirling motion to be imparted to said tube second end.

2. The orbital dispenser of claim 1, wherein said tube is adhesively affixed to said housing first end.

3. The orbital dispenser of claim 1, wherein said tube is carried in a bearing relative to said rotary motion means.

4. The orbital dispenser of claim 1, further comprising means for varying the speed of said motor.

5. The orbital dispenser of claim 1, further comprising a flexible bellows, said bellows having a central aperture sealing said fluid tube and a periphery retained by said housing.

* * * * *